United States Patent [19]

Cole et al.

[11] 4,099,670

[45] Jul. 11, 1978

[54] ADJUSTABLE HEIGHT SPRINKLER

[76] Inventors: Judson C. Cole, 1318 E. 25 St., Tulsa, Okla. 74114; Eldon W. Morain, 7305 S. 73 E. Ave., Broken Arrow, Okla. 74012

[21] Appl. No.: 761,798

[22] Filed: Jan. 24, 1977

[51] Int. Cl.[2] ..... B05B 15/10

[52] U.S. Cl. ..... 239/205; 285/302

[58] Field of Search ..... 239/204–206; 285/302

[56] References Cited

U.S. PATENT DOCUMENTS

| | | | |
|---|---|---|---|
| 634,344 | 10/1899 | Henning | 285/302 X |
| 3,033,467 | 5/1962 | Hofer | 239/204 |
| 3,776,463 | 12/1973 | Dyck | 239/204 |

*Primary Examiner*—Robert W. Saifer

*Attorney, Agent, or Firm*—Head, Johnson & Chafin

[57] ABSTRACT

An adjustable height sprinkler apparatus having three tubular portions telescopically received within each other. The base portion is buried vertically in the ground and connected to a source of water pressure at the lower end, the upper end being adjacent the earth's surface. A second tubular extension member is vertically positionable by telescopic displacement relative to the base member and includes a coupling for sealably retaining the extension member in the selected vertical position. A third tubular pop-up member is telescopically positioned in the extension member and slidable downwardly by gravity and displaced upwardly when water pressure is applied to the sprinkler, the pop-up member having an enlarged diameter portion at the upper end with means for attaching a sprinkler head. In the preferred embodiment the upper end of the tubular extension is in a plane displaced relative to the tubular axis and the lower surface of the enlarged portion of the pop-up member is in a similar displaced plane so that when water pressure ceases and the pop-up member falls downwardly, the planar surfaces engage each other to maintain a preselected angular relationship between the pop-up member and the extension member.

3 Claims, 5 Drawing Figures

ADJUSTABLE HEIGHT SPRINKLER

BACKGROUND AND OBJECTS OF THE INVENTION

The use of sprinklers for spraying lawns and shrubs is well known. The present invention is directed towards a sprinkler particularly adapted for spraying shrubbery and most particularly is of a type which is completely concealed within the shrubbery when not involved in a sprinkling cycle and which can be varied in height as the height of the shrubbery varies and, further, which pops up above the shrubbery so as to spray in an unobstructed manner.

One problem with providing a concealed sprinkler for shrubbery is that shrubbery grows and as it grows the height of the sprinkler must be varied. With normal sprinkling equipment this is a difficult job in that it requires replacement of the vertical portion of the sprinkler piping system. The present invention solves this problem by providing a tubular extension which can be raised and lowered without disrupting the sprinkler system. However, the invention goes a step further in that it not only provides a sprinkler which can be varied in height but one which is concealed from view when not serving in a sprinkling function and which pops up to extend above the shrubbery in which it is placed when water pressure is applied to the sprinkler during a sprinkling cycle.

A further difficulty with the known type of pop-up sprinklers is that is difficult to maintain orientation of the sprinkler head. The present invention includes means whereby the sprinkler pops up due to the effect of water pressure so as to extend above the shrubbery in which the device is positioned, thereby permitting the entire sprinkler to be concealed when not in use, but also includes an arrangement wherein the pop-up portion returns to a pre-selected angular relationship relative to the lower portions of the sprinkler ensuring that the sprinkler head is properly oriented when water pressure is applied.

It is therefore an object of this invention to provide an improved adjustable height sprinkler apparatus.

More particularly, an object of this invention is to provide a sprinkler apparatus, particularly adaptable for use in sprinkling shrubbery, including means whereby the height of the sprinkler may be easily adjusted as the height of the shrubbery changes.

Still more particularly, an object of this invention is to provide an adjustable height sprinkler including a pop-up feature so that the sprinker may be completely hidden when not in use, and in which the sprinkler head pops up above the shrubbery when water pressure is applied, and including means for maintaining preselected orientation of the sprinkler head.

These objects, as well as other and more specific objects of the invention, will be fulfilled in the following description and claims, taken in conjunction with the attached drawings.

DESCRIPTION OF VIEWS

FIG. 2 shows the sprinkler at the maximum height but without water pressure applied.

SUMMARY OF THE INVENTION

An adjustable height sprinkler apparatus including a tubular base for burying in the ground with means at the lower end for attachment to a source of water pressure and with the upper end adjacent the earth's surface, a tubular extension slidably and telescopically positioned within the tubular base portion and selectably extendable from the lower to an upper position, a coupling member for selectably and sealably retaining the extension member relative to the base member, and a tubular pop-up member slidably and telescopically received in the extension member having means for limiting the upward and downward travel thereof relative to the extensive member, the upper end of the pop-up member having means for receiving a sprinkler head, the pop-up member being slidably downwardly positioned by gravity when water pressure is not applied.

DETAILED DESCRIPTION OF THE DRAWINGS

Figure 1:
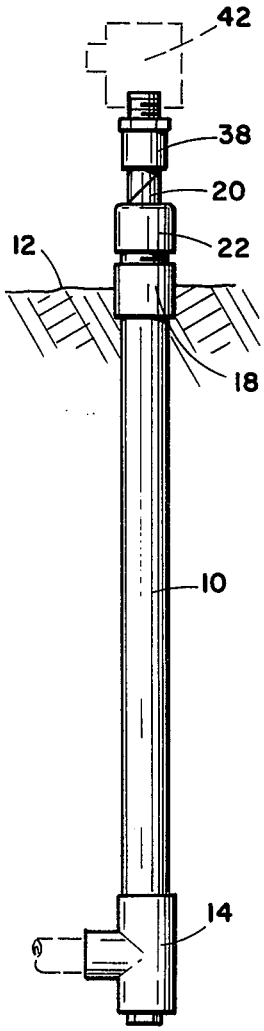
FIG. 1 is an elevational view of an embodiment of the sprinkler of this invention shown mounted in the earth and showing the sprinkler adjusted to a minimum height, such as would be applicable when shrubbery is first planted or when it has been trimmed back.
Figure 4:
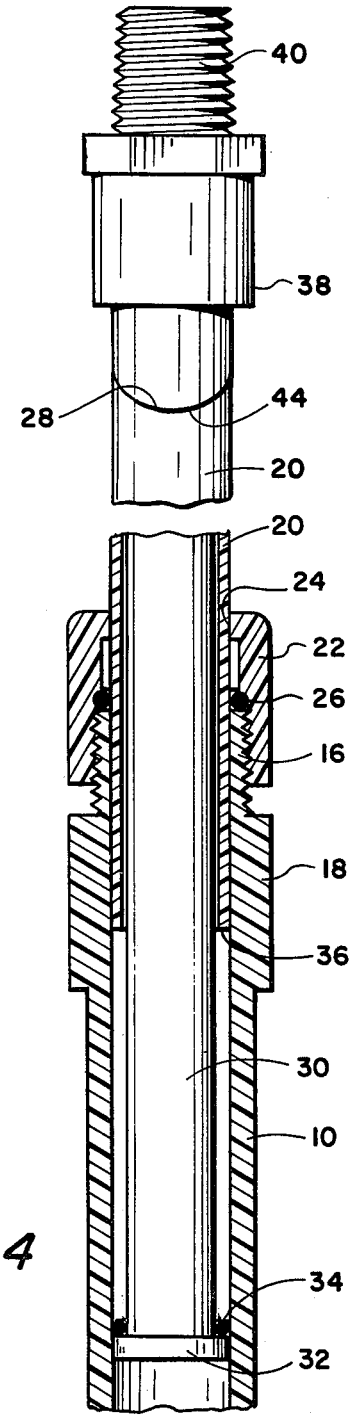
FIG. 4 is an enlarged cross-sectional view of the upper end of the tubular base portion and the extension portion with the pop-up portion in the downward position as occurs when no water pressure is applied.

Referring to the drawings and first to FIGS. 1 and 4, a tubular base member 10 is buried uprightly in the ground with the upper end adjacent the earth's surface 12. The lower end is adapted to receive a source of water pressure such as by means of a tee fitting 14. The length of the tubular base member 10 will depend upon the maximum extension desired for the sprinkler with the typical length being approximately one to three feet, with a two feet length being average.

As shown in the cross-sectional view of FIG. 4, the upper end of the base member 10 is provided with a threaded portion 16 and may further include an enlarged external diameter portion 18 adjacent the threaded portion 16.

Telescopically and slidably received within the base portion 10 is a tubular extension member 20. A coupling member 22 having internal thread has an opening 24 of a diameter to receive the tubular extension 22 and serves as a means of securing the tubular extension 22 to the base member 10. A gasket 26 is positioned between the coupling 22 and the upper end of the base member 10 to provide a leakproof seal when the coupling member is tightened.

Figure 5:
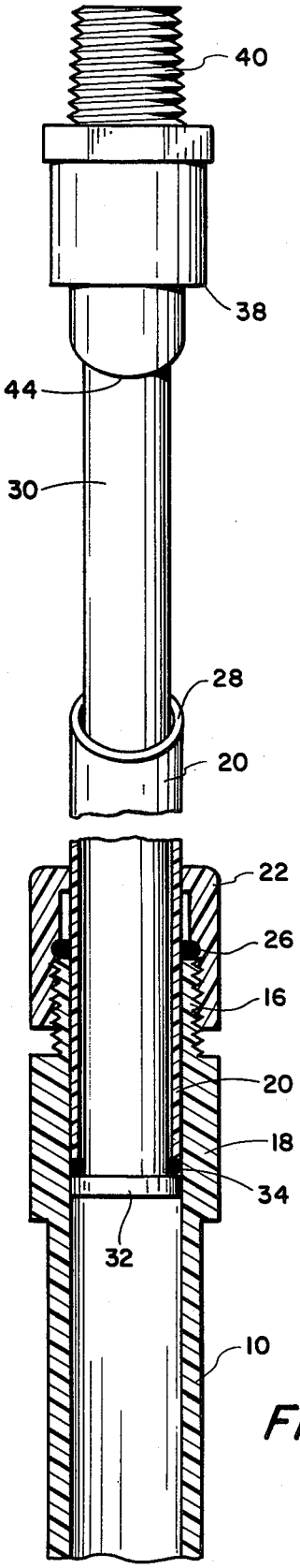
FIG. 5 is the same view as FIG. 4 but in the attitude the sprinkler takes when water pressure is applied showing the pop-up portion in the upward position.

The length of the tubular extension 20 is preferably slightly longer than the base member 10. However, the length of the extension member 20 determines only the minimum height of the sprinkler and if it is substantially longer than the base member 10 it means only that the minimum height of sprinkler may not be reduced more than the difference in the length of the two members. The upper end 28 of extension member 22 is in a plane which forms an angle with the longitudinal axis of the member. Preferably the plane of end 28 has an angle between 15° and 75° relative to the tubular member axis for purposes which will be described subsequently. Slidably and telescopically received in tubular extension 20 is a tubular pop-up member 30. The outside diameter of the pop-up member 30 is slightly less than the inside diameter of the tubular extension member 20 so that the pop-up member 30 falls freely downwardly by gravity when no water pressure is applied to the sprinkler, and is easily raised by water pressure within the sprinkler when a sprinkling cycle begins. Means must be provided to limit the upward and downward travel of the pop-up member 30 relative to the extension member 20. One method of achieving this is by the provision of a flange 32 affixed to the lower end of the pop-up member, the outside diameter of the flange 32 being slightly less than the inside diameter of the base portion 10. In this arrangement the length of the pop-up member 30 must be greater than the length of tubular extension 20. A gasket 34 is positioned around the lower end of the pop-up member 30 and adjacent the flange 20. The gasket 34 engages the lower end 36 of the extension member 20 when the pop-up member is in the upper position, as shown in FIG. 5, as occurs when water pressure is applied to the interior of the base member 10.

Figure 2:
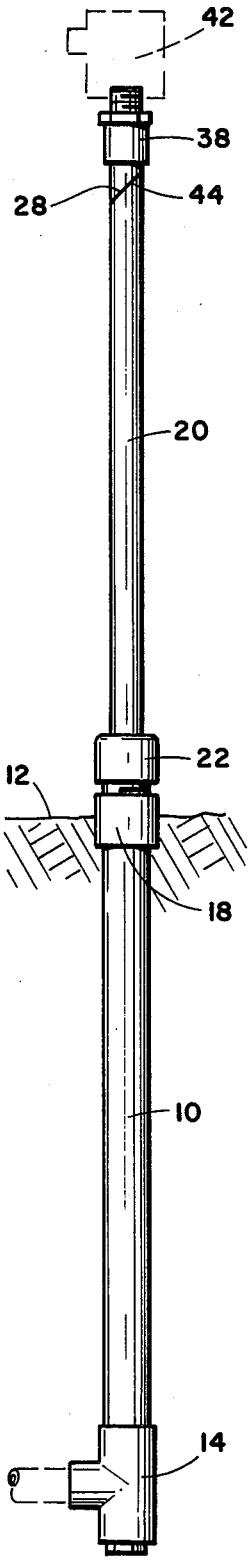
FIG. 2 shows the adjustable height sprinkler as in FIG. 1 but showing it adjusted to the maximum height as when shrubbery has grown.
Figure 3:
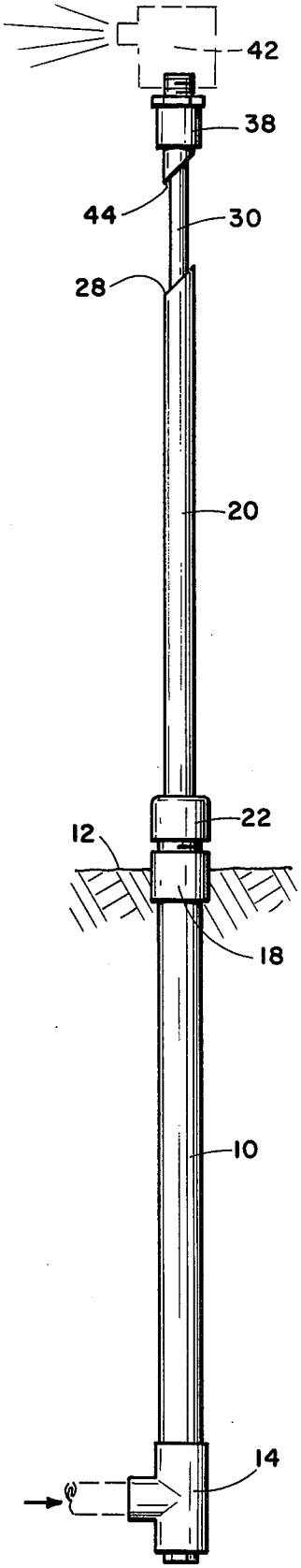
FIG. 3 shows the sprinkler adjust its maximum height and showing the pop-up portion upwardly extended as occurs when water pressure is applied.

The upper end of the pop-up member 30 has an enlarged diameter portion 38 (shown with two different outside diameter portions) including means such as threads 40 for attachment of a sprinkler head 42 shown in dotted outline in FIGS. 2 and 3. The sprinkler head is shown in dotted outline since it is not a part of the invention itself and a great variety of sprinkler heads are commercially available to spray varying patterns as required by the orientation of the shrubbery to be watered by the sprinkler.

The lower surface 44 of the enlarged diameter portion 38 is preferably in a plane relative to the tubular axis of pop-up member 30 the same as the plane of the extension member upper end 28. When water pressure is removed at the end of a sprinkling cycle, gravity causes the pop-up member 30 to fall downwardly within the tubular extension member 20. As it falls downwardly the inclined planar surfaces 28 and 44 meet and if they are not in angular alignment the pop-up member 30 is caused to rotate so that they align for maximum downward travel of the pop-up member. This arrangement insures that the angular relationship of the pop-up member 30 relative to the extension member 20 remains the same at the end of each cycle. When water pressure is applied the pop-up member 30 immediately is forced upwardly and since there is no force tending to rotate it relative to the extension member 20, it will pop upwardly in the same angular relationship. Thus by the provision of the inclined planar surfaces 28 and 44 a means is provided to maintain preselected angular relationship of the tubular pop-up member 30 and the tubular extension member 20. The frictional force of gasket 34 between flange 32 and the lower end 36 of the tubular extension 20 will prevent the pop-up member 30 from rotating after water pressure is applied to raise it into the upper position. If the user wants to realign the sprinkler head 42, he can do so by loosening the coupling member 22 and rotating the extension member 20. Thus the extension member 20 can be used not only to vary the height of the sprinkler but also the directional orientation and in a manner wherein no other alignment elements are required between the extension member 20 and the pop-up member 30.

It can be seen that the adjustable height sprinkler which has been described fulfills all of the objectives initially set forth. The user can adjust the height of the sprinkler by raising the extension member 20 relative to the base 10 as required to change the height of the sprinkler as the height of shrubbery changes either due to growth of the shrubbery, pruning, or so forth. The height of the sprinkler can be raised so that the sprinkler head 42 is concealed just below the height of the shrubbery. Nevertheless, when water pressure is applied it will pop-up above the shrubbery to provide an uninterrupted spray. The orientation and height of the sprinkler can be changed merely by loosening the coupling member 22.

The components of the sprinkler may be made either of metal or plastic, however, plastic such as polyvinyl chloride, polyethylene or so forth is preferred because of reduced weight, expense, and the fact that they are not deleteriously affected by water.

The invention provides a unique yet very simple means of achieving an adjustable height sprinkler superior to other known sprinklers presently available. While the invention has been described with a great deal of particularity, it is manifest that many changes may be made in the details of construction and the arrangement of components without departing from the spirit and scope of this disclosure. It is understood that the invention is not to be limited by the exemplified embodiment which has been described, but is to be limited only by the scope of the attached claim or claims, including the full range of equivalency to which each element thereof is entitled.

What is claimed:

1. An adjustable height sprinkling apparatus comprising:

a tubular base member adapted to be buried vertically in the ground having a threaded upper end adjacent the ground surface and having means at the lower end for connection to a source of water pressure;

a tubular extension member telescopically received in said base member;

a coupling member threadably attached to said base member threaded upper end having an opening slidably receiving said extension member and having gasket means for leak-proof locking said extension member to said base member in selectable telescopic relationship;

a tubular pop-up member slidably and telescopically received in said tubular extension, said pop-up member being longer than said extension member and including a flange affixed to the lower end of said pop-up member below the lower end of said extension member, the flange being of outside diameter less than said base member internal diameter the flange serving to limit the upper travel of said pop-up member by engagement with the lower end of said extension member, and the pop-up member having means at the upper end thereof to receive a spray head, the pop-up member being normally downwardly displaced relative to said extension member by gravity and being upwardly displaced by water pressure.

2. An adjustable height sprinkler according to claim 1 including a gasket positioned around said pop-up member and adjacent said flange, the gasket serving to seal against leakage between said flange and the lower end of said extension member when said pop-up member is displaced upwardly by water pressure.

3. An adjustable height sprinkler according to claim 1 including an enlarged diameter coupling member affixed to said pop-up member at the upper end thereof serving to limit the downward travel of the pop-up member by engagement with the upper end of said extension member and wherein the upper end of said extension member is in a plane having angle of from 15° to 75° to the pop-up member tubular axis and wherein the lower surface of the enlarged diameter coupling member is in a plane having the same angle relative to the tubular axis of said pop-up member whereby as said pop-up member slides downwardly when water pressure ceases the said planar surfaces will cause said pop-up member to return to the same rotational relationship with said extension member.

* * * * *